US008191628B2

(12) United States Patent
Konschuh et al.

(10) Patent No.: US 8,191,628 B2
(45) Date of Patent: Jun. 5, 2012

(54) METHOD AND APPARATUS FOR TRANSMITTING SENSOR RESPONSE DATA AND POWER THROUGH A MUD MOTOR

(75) Inventors: Christopher Walter Konschuh, Calgary (CA); Michael Louis Larronde, Houston, TX (US); Larry Wayne Thompson, Willis, TX (US); MacMillan M. Wisler, Kingwood, TX (US)

(73) Assignee: Weatherford Canada Partnership, Edmonton (CA)

( * ) Notice: Subject to any disclaimer, the term of this patent is extended or adjusted under 35 U.S.C. 154(b) by 0 days.

(21) Appl. No.: 13/191,577

(22) Filed: Jul. 27, 2011

(65) Prior Publication Data

US 2011/0278066 A1 Nov. 17, 2011

Related U.S. Application Data

(60) Division of application No. 12/904,301, filed on Oct. 14, 2010, now Pat. No. 8,011,425, which is a continuation of application No. 11/937,951, filed on Nov. 9, 2007, now abandoned, which is a division of application No. 11/203,057, filed on Oct. 7, 2005, now Pat. No. 7,303,007.

(51) Int. Cl.
*E21B 47/12* (2012.01)

(52) U.S. Cl. ..... 166/250.01; 166/66.5; 166/104; 175/107; 175/40

(58) Field of Classification Search ..... 175/40, 175/107; 340/854.3, 854.6, 855.1; 166/66.5, 166/250.01, 104
See application file for complete search history.

(56) References Cited

U.S. PATENT DOCUMENTS

| | | | |
|---|---|---|---|
| 3,090,031 | A | 5/1963 | Lord |
| 3,280,923 | A | 10/1966 | Muench |
| 3,866,678 | A | 2/1975 | Jeter |
| 4,051,456 | A | 9/1977 | Heilhecker et al. |
| 4,562,560 | A | 12/1985 | Kamp |
| 5,058,077 | A | 10/1991 | Twist |
| 5,160,925 | A | 11/1992 | Dailey et al. |
| 5,725,061 | A | 3/1998 | Van Steenwyk et al. |

(Continued)

FOREIGN PATENT DOCUMENTS

WO 2004046505 A2 6/2004

OTHER PUBLICATIONS

Magnetic dipole. (Sep. 12, 2011). In Wikipedia, The Free Encyclopedia. Retrieved 19:38, Oct. 27, 2011, from http://en.wikipedia.org/w/index.php?title=Magnetic_dipole&oldid=450123058.*

(Continued)

*Primary Examiner* — David Bagnell
*Assistant Examiner* — Robert E Fuller
(74) *Attorney, Agent, or Firm* — Wong, Cabello, Lutsch, Rutherford & Brucculeri, L.L.P.

(57) ABSTRACT

Apparatus and methods for establishing electrical communication between an instrument subsection disposed below a mud motor and an electronics sonde disposed above the mud motor in a drill string conveyed borehole logging system. Electrical communication is established via at least one conductor disposed within the mud motor and connecting the instrument sub section to a link disposed between the mud motor and the electronics sonde. The link can be embodied as a current coupling link, a magnetic coupling ling, an electromagnetic telemetry ling and a direct electrical contact link. Two way data transfer is established in all link embodiments. Power transfer is also established in all but the electromagnetic telemetry link.

17 Claims, 8 Drawing Sheets

U.S. PATENT DOCUMENTS

| | | | |
|---|---|---|---|
| 6,392,561 | B1 | 5/2002 | Davies et al. |
| 6,540,032 | B1 | 4/2003 | Krueger |
| 7,084,782 | B2 | 8/2006 | Davies et al. |
| 7,303,007 | B2 | 12/2007 | Konschuh et al. |
| 2003/0213620 | A1 | 11/2003 | Krueger |
| 2005/0194187 | A1 | 9/2005 | Gleitman et al. |

OTHER PUBLICATIONS

Office Action received in corresponding U.S. Appl. No. 11/203,057 dated Dec. 21, 2006.

PCT Search Report received in International Application No. PCT/US06/33343 dated May 17, 2007.

Office Action received in corresponding U.S. Appl. No. 11/937,951 dated Apr. 21, 2008.

Office Action received in corresponding U.S. Appl. No. 11/937,951 dated Jun. 11, 2009.

Office Action received in corresponding U.S. Appl. No. 11/937,951 dated Jan. 13, 2010.

Office Action received in corresponding U.S. Appl. No. 11/937,951 dated Jun. 16, 2010.

slip.ring. (n.d.). The American Heritage® Dictionary of the English Language, Fourth Edition. Retrieved Jun. 8, 2010, from Dictionary.com website: http://dictionary.reference.com/browse/slip ring.

Office Action received in corresponding U.S. Appl. No. 12/904,301 dated Jan. 11, 2011.

* cited by examiner

METHOD AND APPARATUS FOR TRANSMITTING SENSOR RESPONSE DATA AND POWER THROUGH A MUD MOTOR

CROSS REFERENCE TO RELATED APPLICATION

This application is a divisional of U.S. application Ser. No. 12/904,301, filed Oct. 14, 2010, which is a continuation of and claims priority to co-pending U.S. application Ser. No. 11/937,951, filed Nov. 9, 2007, which is a divisional of U.S. application Ser. No. 11/203,057, filed Oct. 7, 2005, now U.S. Pat. No. 7,303,007. The entire contents of each application is incorporated herein by reference.

FIELD OF THE INVENTION

This invention is related to measurements made while drilling a well borehole, and more particularly toward methodology for transferring data between the surface of the earth and sensors or other instrumentation disposed below a mud motor in a drill string.

BACKGROUND

Borehole geophysics encompasses a wide range of parametric borehole measurements. Included are measurements of chemical and physical properties of earth formations penetrated by the borehole, as well as properties of the borehole and material therein. Measurements are also made to determine the path of the borehole. These measurements can be made during drilling and used to steer the drilling operation, or after drilling for use in planning additional well locations.

Borehole instruments or "tools" comprise one or more sensors that are used to measure "logs" of parameters of interest as a function of depth within the borehole. These tools and their corresponding sensors typically fall into two categories. The first category is "wireline" tools wherein a "logging" tool is conveyed along a borehole after the borehole has been drilled. Conveyance is provided by a wireline with one end attached to the tool and a second end attached to a winch assembly at the surface of the earth. The second category is logging-while-drilling (LWD) or measurement-while-drilling (MWD) tools, wherein the logging tool is an element of a bottom hole assembly. The bottom hole assembly is conveyed along the borehole by a drill string, and measurements are made with the tool while the borehole is being drilled.

A drill string typically comprises a tubular which is terminated at a lower end by a drill bit, and terminated at an upper end at the surface of the earth by a "drilling rig" which comprises draw works and other apparatus used to control the drill string in advancing the borehole. The drilling rig also comprises pumps that circulate drilling fluid or drilling "mud" downward through the tubular drill string. The drilling mud exits through opening in the drill bit, and returns to the surface of the earth via the annulus defined by the wall of the borehole and the outer surface of the drill string. A mud motor is often disposed above the drill bit. Mud flowing through a rotor-stator element of the mud motor imparts torque to the bit thereby rotating the bit and advancing the borehole. The circulating drilling mud performs other functions that are known in the art. These functions including providing a means for removing drill bit cutting from the borehole, controlling pressure within the borehole, and cooling the drill bit.

In LWD/MWD systems, it is typically advantageous to place the one or more sensors, which are responsive to parameters of interest, as near to the drill bit as possible. Close proximity to the drill bit provides measurements that most closely represent the environment in which the drill bit resides. Sensor responses are transferred to a downhole telemetry unit, which is typically disposed within a drill collar. Sensor responses are then telemetered uphole and typically to the surface of the earth via a variety of telemetry systems such as mud pulse, electromagnetic and acoustic systems. Conversely, information can be transferred from the surface through an uphole telemetry unit and received by the downhole telemetry unit. This "down-link" information can be used to control the sensors, or to control the direction in which the borehole is being advanced.

If a mud motor is not disposed within the bottom hole assembly of the drill string, sensors and other borehole equipment are typically "hard wired" to the downhole telemetry unit using one or more electrical conductors. If a mud motor is disposed in the bottom hole assembly, the rotational nature of the mud motor presents obstacles to sensor hard wiring, since the sensors rotate with respect to the downhole telemetry unit. Several technical and operational options are, however, available.

A first option is to dispose the sensors and related power supplies above the mud motor. The major advantage is that the sensors do not rotate and can be hard wired to the downhole telemetry unit without interference of the mud motor. A major disadvantage is, however, that the sensors are displaces a significant axial distance from the drill bit thereby yielding responses not representative of the current position of the drill bit. This can be especially detrimental in geosteering systems, as discussed later herein.

A second option is to dispose the sensors immediately above the drill bit and below the mud motor. The major advantage is that sensors are disposed near the drill bit. A major disadvantage is that communication between the non rotating downhole telemetry unit and the rotating sensors and other equipment must span the mud motor. The issue of power to the sensors and other related equipment must also be addressed. Short range electromagnetic telemetry systems, known as "short-hop" systems in the art, are used to telemeter data across the mud motor and between the downhole telemetry unit and the one or more sensors. Sensor power supplies must be located below the mud motor. This methodology adds cost and operational complexity to the bottom hole assembly, increases power consumption, and can be adversely affected by electromagnetic properties of the borehole and the formation in the vicinity of the bottom hole assembly.

A third option is to dispose the one or more sensors below the mud motor and to hard wire the sensors to the top of the mud motor using one or more conductors disposed within rotating elements of the mud motor. A preferably two-way transmission link is then established between the top of the mud motor and the downhole telemetry unit. U.S. Pat. No. 5,725,061 discloses a plurality of conductors disposed within rotating elements of a mud motor, wherein the conductors are used to connect sensors below the mud motor to a downhole telemetry unit above the motor. In one embodiment, electrical connection between rotating and non rotating elements is obtained by axially aligned contact connectors at the top of the mud motor. This type of connector is known in the art as a "wet connector" and is used to establish a direct contact electrical communication link. In another embodiment, an electrical communication link is obtained using an axially aligned, non-contacting split transformer. The rotating and non rotating elements are magnetically coupled using this embodiment thereby providing the desired communication link.

SUMMARY

This disclosure is directed toward LWD/MWD systems in which a mud motor is incorporated within the bottom hole assembly. More specifically, the disclosure sets forth apparatus and methods for establishing electrical communication between elements, such as sensors, disposed below the mud motor and a downhole telemetry unit disposed above the mud motor.

The bottom hole assembly terminates the lower end of a drill string. The drill string can comprise joints of drill pipe or coiled tubing. The lower or "downhole" end of the bottom hole assembly is terminated by a drill bit. An instrument subsection or "sub" comprising one or more sensors, required sensor control circuitry, and optionally a processor and a source of electrical power, is disposed immediately above the drill bit. The elements of the instrument sub are preferably disposed within the wall of the instrument sub so as not to impede the flow of drilling mud. The upper end of the instrument sub is operationally connected to a lower end of a mud motor. One or more electrical conductors pass from the instrument sub and through the mud motor and terminated at a motor connector assembly at the top of the mud motor. The mud motor is operationally connected to the electronics sub comprising an electronics sonde. This connection is made by electrically linking the motor connector assembly to a downhole telemetry connector assembly disposed preferably within an electronics sub. The electronics sonde element of the electronics sub can further comprise the downhole telemetry unit, power supplies, additional sensors, processors and control electronics. Alternately, some of these elements can be mounted in the wall of the electronics sub.

Several embodiments can be used to obtain the desired electrical communication link between the mud motor connector and the downhole telemetry connector assembly. As stated previously, this link connects sensors and circuitry in the instrument package with uphole elements typically disposed at the surface of the earth.

In one embodiment, a communication link is established between the mud motor connector and the downhole telemetry connector assemblies using an electromagnetic transceiver link. The axial extent of this transceiver link system is much less than a communications link between the instrument sub, and across the mud motor, to the telemetry sub, commonly referred to as a "short hop" in the industry. This, in turn, conserves power and is mush less affected by electromagnetic properties of the borehole environs. The transceiver communication link can be embodied as two-way data communication link. The transceiver link is not suitable for transmitting power downward to the sensor sub.

In another embodiment, a flex shaft is used to mechanically connect the rotor element of the mud motor to the lower end of the electronics sub. The flex shaft is used to compensate for this misalignment, with the upper end of the flex shaft being received along the major axis of the electronics sub. Stated another way, the flex shaft compensates, at the electronics sub, for any axial movement of the rotor while rotating. The one or more wires passing through the interior of the rotor are electrically connected to a lower toroid disposed around and affixed to the flex shaft. The lower toroid rotates with the rotor. An upper toroid is disposed around the flex shaft in the immediate vicinity of the lower toroid. Both the upper and lower toroids are hermetically sealed preferably within an electronics sonde. The upper toroid is fixed with respect to the non rotating electronics sonde thereby allowing the flex shaft to rotate within the upper toroid. Upper and lower toroids are current coupled through the flex shaft as a center conductor thereby establishing the desired two-way data link and power transfer link between the sensors below the mud motor and the downhole telemetry unit above the mud motor. The upper toroid is hard wired to the downhole telemetry element.

In still another embodiment, the flex shaft arrangement discussed above is again used. The upper, non rotating toroid is again disposed around the flex shaft as discussed previously. In this embodiment, the lower toroid is electrically connected to conductors passing through the rotor and is disposed near the bottom of the flex shaft and near the top of the mud motor. The lower toroid is hermetically sealed within the mud motor. The upper toroid is hermetically sealed within the electronics sub. The two-way data link and power transfer link is again established via current coupling by the relative rotation of the lower and upper toroids, with the flex shaft functioning as a center conductor.

In yet another embodiment, the conductors are electrically connected to axially displaced rings at or near the top of the flex shaft. The rings, which rotate with the stator and the flex shaft, are contacted by non rotating electrical contacting means such as brushes. The brushes are electrically connected to the downhole telemetry element within the electronics sonde of the telemetry sub. Other suitable non rotating electrical contacting means may be used such as conducting spring tabs, conducting bearings and the like. The desired communication link is thereby established between the mud motor and the electronics sub by direct electrical contact. This embodiment also permits two way data transfer, and also allows power to be transmitted from above the mud motor to elements below the mud motor. Power can also be transmitted downward through the mud motor to the instrument sub.

In still another embodiment, a lower and an upper magnetic dipole are used to establish a magnetic coupling link. The flex shaft used in previous embodiments is not required. This link is not suitable for the transfer of power.

BRIEF DESCRIPTION OF THE DRAWINGS

So that the manner in which the above recited features, advantages and objects the present invention are obtained and can be understood in detail, more particular description of the invention, briefly summarized above, may be had by reference to the embodiments thereof which are illustrated in the appended drawings.

DETAILED DESCRIPTION

This section of the disclosure will present an overview of the system, details of link embodiments, and an illustration the use of the system to determine one or more parameters of interest.

Figure 1:
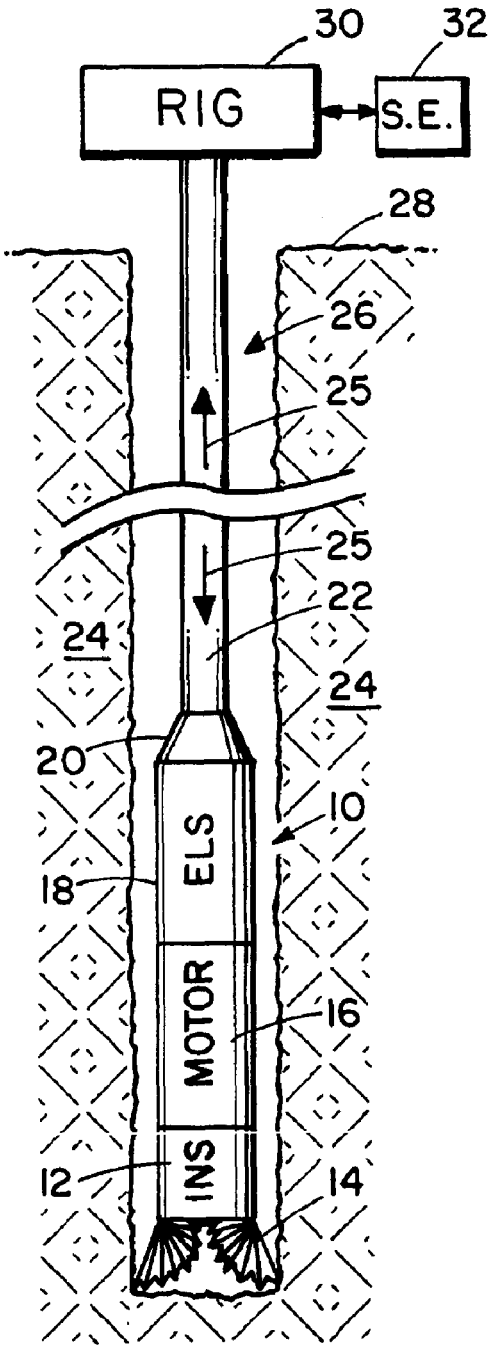
FIG. 1 is a conceptual illustration of the major elements of the invention disposed in a well borehole.

FIG. 1 is a conceptual illustration of the major elements of the invention disposed in a well borehole 26 penetrating earth formation 24. A bottom hole assembly, designated as a whole by the numeral 10, comprises an instrument subsection or "sub" 12, a mud motor 16, and an electronics sub 18. The instrument sub 12 is terminated at a lower end by a drill bit 14 and operationally connected at an upper end to a lower end of a mud motor 16. The upper end of the mud motor 16 is operationally connected to a lower end of an electronics sub 18. The upper end of the electronics sub 18 is operationally connected to a drill string 22 by means of a connector head 20. The drill string 22 terminates at an upper end at a rotary drilling rig that is well known in the art and indicated conceptually at 30. The drilling rig 30 cooperates with surface equipment 32 which typically comprises an uphole telemetry unit (not shown), means for determining depth of the drill bit 14 in the borehole 26 (not shown), and a surface processor (not shown) for combining sensor response from one or more sensors in the bottom hole assembly 10 with corresponding depth to form a "log" of one or more parameters of interest. Data are transfer between the electronics sub 18 and the uphole telemetry unit by telemetry systems known in the art including mud pulse, acoustic, and electromagnetic systems. This two-way data transfer is illustrated conceptually by the arrows 25.

It is noted that the drill string 22 can be replaced with coiled tubing, and the drilling rig 30 replaced with a coiled tubing injector/extractor unit. Telemetry can incorporate conductors inside or disposed in the wall of the coiled tubing.

Figure 2:
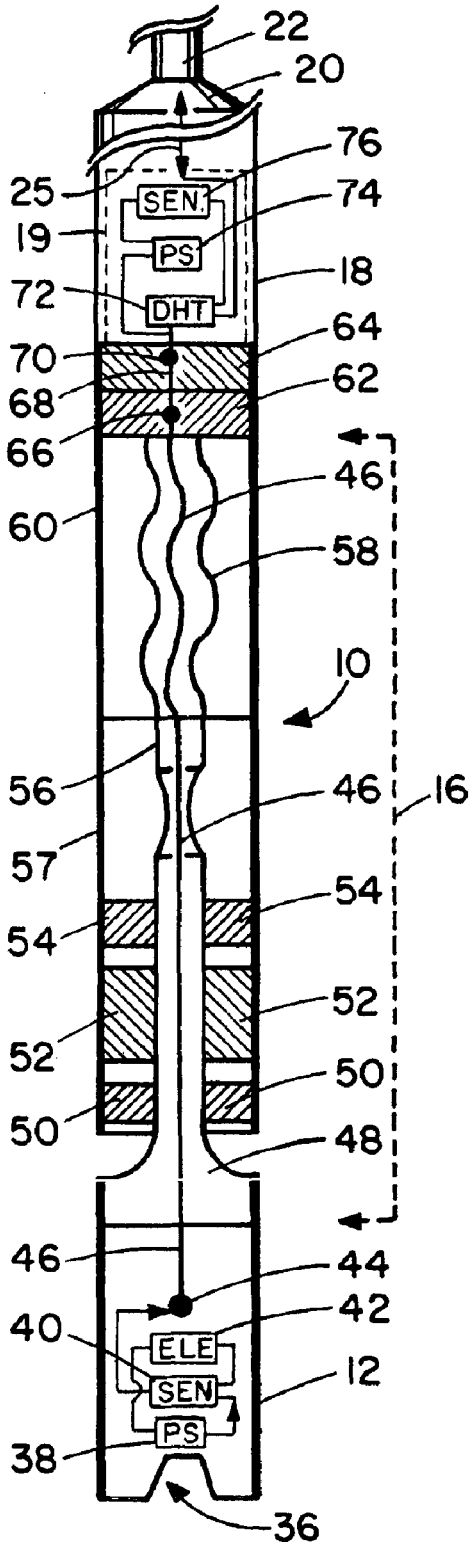
FIG. 2 illustrates in more detail the elements of the bottom hole assembly of the invention.

FIG. 2 illustrates in more detail the elements of the bottom hole assembly 10. The drill bit 14 (see FIG. 1), which is received by the instrument bit box 36, is not shown. Moving upward through the elements of the bottom hole assembly 10, the instrument sub 12 comprises at least one sensor 40 and an electronics package 42 to control the at least one sensor 40. A power supply 38, such as a battery, powers the at least one sensor 40 and electronics package 42 in embodiments in which power can not be supplied by from sources above the mud motor 16. The electronics package 42 typically comprise electronics to control the one or more sensors 40, and a processor which processes, preprocesses, and conditions sensor response data for telemetering. The at least one sensor 40 and electronics package 42 are electrically connected to a lower terminus 44 of one or more conductors 46 that extend upward through the bottom hole assembly 10. These conductors can be single strands of wire, twisted pairs, shielded multiconductor cable, coaxial cable and the like. Alternately, the conductors 46 can be optical fiber, with the instrument sub 12 comprising suitable elements (not shown) for convert electrical sensor response signals to corresponding optical signals. The one or more sensors 40 can be essentially any type of sensing or measuring device used in geophysical borehole measurements. These sensor types include, but are not limited to, gamma radiation detectors, neutron detectors, inclinometers, accelerometers, acoustic sensors, electromagnetic sensors, pressure sensors, and the like. An example of a log generated by a gamma ray detector and a measure of bottom hole assembly inclination will be presented in a subsequent section of this disclosure. When possible, elements of the instrument sub 12 are mounted within the sub wall so as not to impede the flow of drilling mud downward through the bottom hole assembly 10.

Still referring to FIG. 2, the instrument sub 12 is connected to a drive shaft 48, which is supported within the bearing section of the mud motor 16 by radial bearings 50 and 54, and by an axial bearing 52. The drive shaft 48 is connected to a rotor 58 by a driver flex shaft 56 that transmits power from the rotor 58 to the drive shaft 48. The driver flex shaft 56 is disposed in a bend section 57 of the mud motor thereby allowing the direction of the drilling to be controlled. The rotor 58 is rotated within a stator 60 by the action of the downward flowing drilling mud. The upper end of the rotor 58 terminates at a mud motor connector 62. Conductors 46, that extend from the lower terminus 44 through the drive shaft 48 and driver flex shaft 56 and rotor 58, terminate at an upper terminus 66 within the mud motor connector 62. The upper terminus 66, like the lower terminus 44 and conductors 46, rotate.

Again referring to FIG. 2, an electronics sonde or insert 19 is disposed within the electronics sub 18. FIG. 2 is conceptual and not to scale. The outside diameter of the electronics sonde 19 is sufficiently smaller than the inside diameter of the electronics sub 18 to form an annulus suitable for mud flow. This annulus is clearly shown at 21 in FIGS. 3-6. The mud motor connector 62 rotatably couples the mud motor 16 to the electronics sub 18 and to the electronics sonde 19 therein through a downhole telemetry connector 64. Mud flows through both the mud motor connector 62 and the downhole telemetry connector 64. The downhole telemetry connector 64 comprises a telemetry terminus 70 that is electrically connected to elements within the electronics sonde 19. These elements include a downhole telemetry unit 72, optionally a power supply 74, and optionally one or more additional sensors 76 of the types previously listed for the one or more instrument sub sensors 40. The electronics sub 18 and electronics sonde 19 are operationally connected to the drill string 22 through the connector 20, and two-way data transfer between the surface telemetry unit (not shown) and the downhole telemetry unit 72 is illustrated conceptually, as in FIG. 1, by the arrow 25.

Once again referring to FIG. 2, a link between the rotating terminus 68 and the non rotating terminus 70 is illustrated by the broken line 68. The following section will detail several embodiments of this link, which allows response of sensors 40 disposed on the downhole side of the mud motor 16 to be transmitted to the surface of the earth thereby allowing the sensors to be disposed in close axial proximity to the drill bit 14.

It is noted that some embodiments do not use a mud motor connector 62 and a downhole telemetry connector 64, with the corresponding terminuses 66 and 70. Other embodiments use variations of the arrangement shown in FIG. 2. The discussion of each linking embodiment will include details of the link connections.

In the context of this disclosure, the term "operational coupling" comprises data transfer, power transfer, or both data and power transfer.

Figure 3:
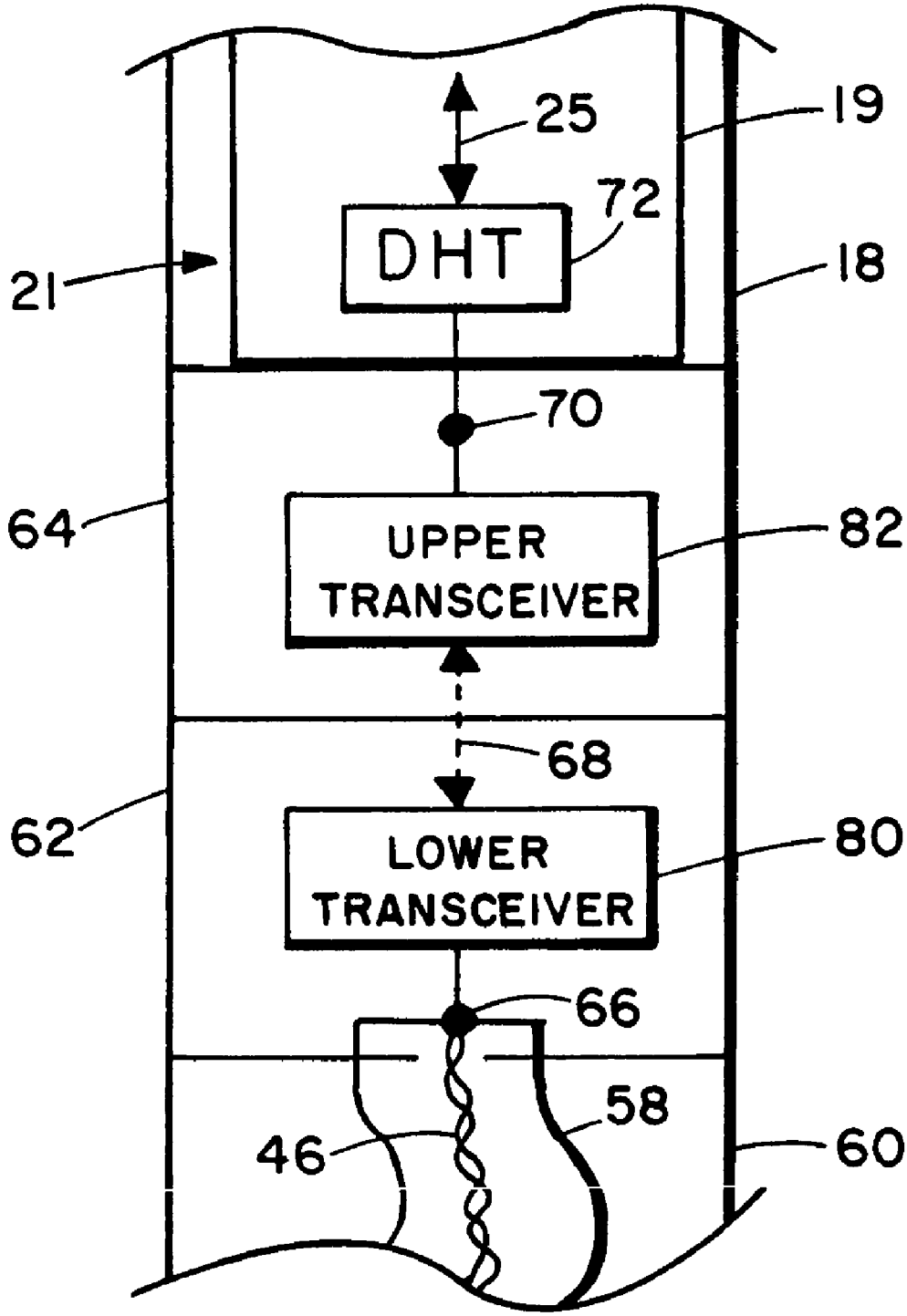
FIG. 3 is a conceptual illustration of an electromagnetic transceiver link between the mud motor and electronics sonde of the bottom hole assembly.

An electromagnetic transceiver link between the mud motor 60 and electronics sonde 19 is shown conceptually in FIG. 3. The conductor 46, shown here as a twisted pair of wires, is again disposed within the rotor 58 and terminates at the terminus 66 within the mud motor connector 62. The terminus is hard wired to a lower transceiver 80 disposed within the mud motor connector 62. As in FIG. 2, the mud motor connector 62 is rotatably attached to the downhole telemetry connector 64, which is attached to the lower end of the electronics sub 18. The downhole telemetry connector 64 contains an upper transceiver 82 hard wired to the terminus 70. The downhole telemetry unit 72 disposed within the electronics sonde 19 is hard wired to the terminus 70. Data are transmitted to and from the downhole telemetry unit 72 and the surface, as indicated conceptually with the arrow 25. The transceiver link, two-way electromagnetic data link between the upper and lower transceivers 82 and 84, respectively, is indicated conceptually by the broken line 68. As stated previously, elements within the downhole telemetry connector 64 and the mud motor connector 62 are disposed to allow drilling mud to flow through. It should be noted that power can also be transmitted to elements within the instrument sub, or alternatively these elements must be powered by a source 38 (see FIG. 2) such as a battery.

Figure 4:
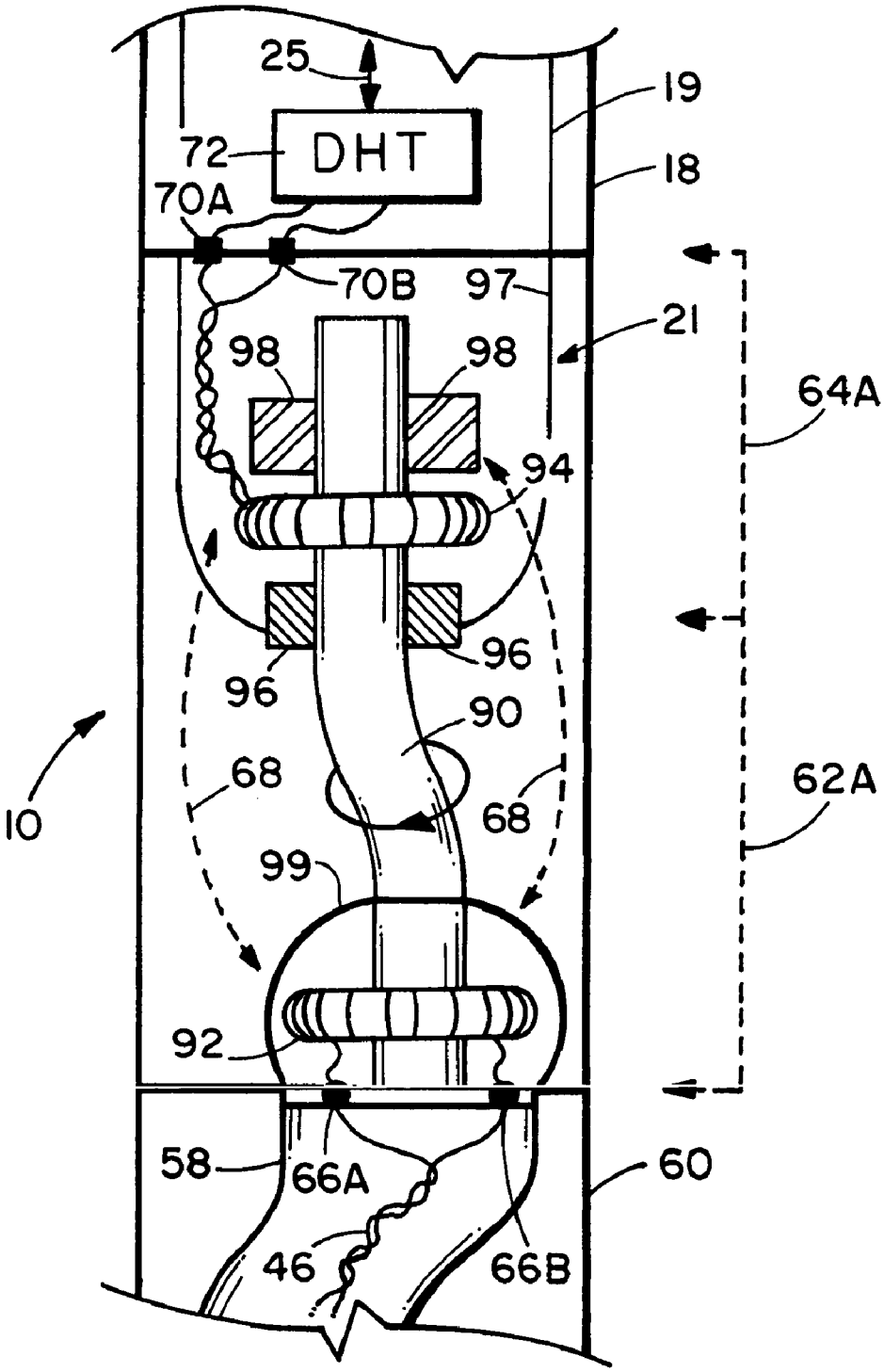
FIG. 4 illustrates a data link embodiment that is based upon current coupling of sensors below a mud motor and a downhole telemetry unit above the mud motor.

FIG. 4 illustrates a data link embodiment that is based upon current coupling of sensors below the mud motor and the downhole telemetry unit above the mud motor. Elements and functions of this embodiment will be discussed beginning at the bottom of the illustration. As in the previous embodiment, the conductors 46 leading from the instrument sub 12 are shown as a twisted pair disposed within the rotor 58. The conductors pass through feed throughs 66A and 66B, that are somewhat analogous to the terminus structure 66 shown in FIGS. 2 and 3. The conductors 46 terminate at a lower toroid 92 that surrounds and rotates with a flex shaft 90. The lower toroid is hermetically sealed from the mud flow by a sealing means such as a rubber boot 99. As stated previously, the flex shaft essentially compensates for axial movement of the rotor, when rotating, with respect to the electronics sub.

Still referring to FIG. 4, the flex shaft extends 90 upward through a pressure housing 97 through a sealing element 96, and is supported by a radial bearing 98 that provides a conductive path to the electronics sonde housing 19. An upper toroid 94 surrounds the upper end of the flex shaft 90. The upper toroid 94 is stationary with respect to the rotating flex shaft 90. Leads from the upper toroid 94 pass through feed throughs 70A and 70B (which are roughly analogous to the terminus 70 in FIGS. 2 and 3) and connect to the downhole telemetry unit 72 disposed in the electronics sonde 19. Data and/or power are transmitted to and from the downhole telemetry unit 72 as illustrated conceptually by the arrow 25.

Again referring to FIG. 4, the upper and lower toroids 94 and 92 rotate with respect to one another thereby forming a current coupling via the flex shaft 90 functioning as a center conductor. It should be understood that, within the context of this disclosure, relative rotation of the upper and lower toroids 92 and 94 also comprises the previously discussed axial movement component of the lower toroid with respect to the upper toroid. The upper end of the flex shaft 90 is electrically connected through the radial bearings 98 to casing of the mud motor 60, which is electrically connected to the rotor 58 through the axial bearings 52 (see FIG. 2), which electrically connected to the lower end of the flex shaft 90 thereby completing the conduction circuit. An upward data link is obtained by applying a data current signal, such as a response of a sensor 40 (see FIG. 2), to the lower toroid 92. A corresponding data current signal is induced in the upper toroid 94, via the previously described current loop, and telemetered to the surface via the downhole telemetry unit 72. Conversely, data can be transmitted to the instrument sub 12 from the surface. This "down-link" data are telemetered from the surface telemetry unit contained in the surface equipment 32 to the downhole telemetry unit 72, converted within the electronics sonde 19 to a current and applied to the upper toroid 94. A corresponding current induced in the lower toroid 92 that is carried to the instrument sub via the conductors 46. The two-way current coupled link is shown conceptually by the broken lines 68. The current link may also be used to transfer power from a source contained in the downhole telemetry unit 72 to the instrument sub 12 in FIG. 2

As mentioned previously, the mud motor connector, downhole telemetry connector, and terminus structure shown in FIG. 4 has been modified in the link embodiment. Axial elements within by the broken line 62A are roughly analogous to mud motor connector and associated terminus. Axial elements within the broken line 64A are roughly analogous to the downhole telemetry connector and associated terminus.

Figure 5:
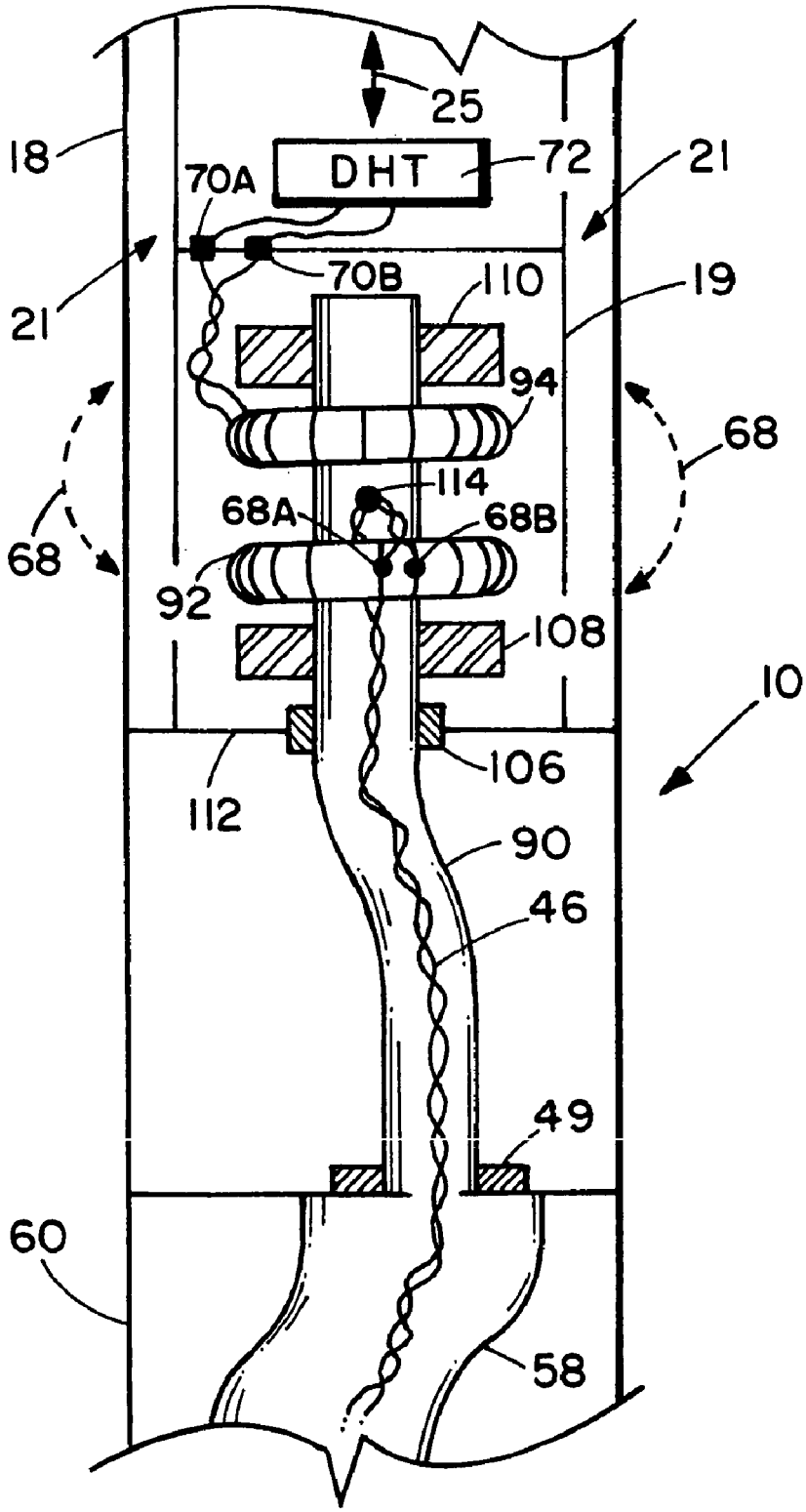
FIG. 5 illustrates another data link embodiment that is based upon current coupling of sensors below a mud motor and a downhole telemetry unit above the mud motor.

FIG. 5 illustrates another embodiment of a data link that is based upon current coupling of sensors below the mud motor and the downhole telemetry unit above the mud motor. Elements and functions of this embodiment will again be discussed beginning at the bottom of the illustration. The lower end of the flex shaft 90 is attached to the rotor 58 by means of a flange 49, and the upper end of the flex shaft 90 extends through a seal 106 and into the electronics sonde 19. Conductors 46 leading from the instrument sub 12 are again shown as a twisted pair disposed within the rotor 58 and the flex shaft 90. The conductors pass through feed through 114 in the wall of the flex shaft 90 and are attach to a lower toroid 92 that surrounds and rotates with a flex shaft 90. A lower electrical conducting radial bearing 108 supports the flex shaft below the lower toroid 92.

Still referring to FIG. 5, the flex shaft 90 extends upward through an upper toroid 94, which is fixed with respect to the electronics sonde 19. The upper toroid 94 is supported by an electrical conducting upper radial bearing 110 disposed above the upper toroid 94. The upper toroid 94 is stationary with respect to the rotating flex shaft 90. Leads from the upper toroid 94 pass through feed throughs 70A and 70B and connect to the downhole telemetry unit 72 disposed in the electronics sonde 19. Data are transmitted to and from the downhole telemetry unit 72 as illustrated conceptually by the arrow 25. Note that the upper and lower toroids 94 and 92, and the upper and lower bearings 110 and 108, are all disposed within the electronics sonde 19.

Again referring to FIG. 5, the upper and lower toroids 94 and 92 rotate with respect to one another thereby forming a current coupling via the flex shaft 90 that functions as a center conductor. The upper end of the flex shaft 90 is electrically connected through the upper radial bearings 110 to housing of the electronics sonde 19, which is electrically connected to the flex shaft 90 through the lower radial bearing 108, which electrically connected to the lower end of the flex shaft 90 thereby completing the conduction circuit. As in the previous embodiment, an upward data link is obtained by applying a data current signal, such as a response of a sensor 40 (see FIG. 2), to the lower toroid 92. A corresponding data current signal is induced in the upper toroid 94, via the previously described current loop, and telemetered to the surface via the downhole telemetry unit 72. Conversely, data can be transmitted to the instrument sub from the surface. The data are telemetered to the downhole telemetry unit 72, converted within the electronics sonde 19 to a current and applied to the upper toroid 94. A corresponding current induced in the lower toroid 92, which is carried to the instrument sub via the conductors 46. The two-way current coupled link is again shown conceptually by the broken lines 68.

Figure 6:
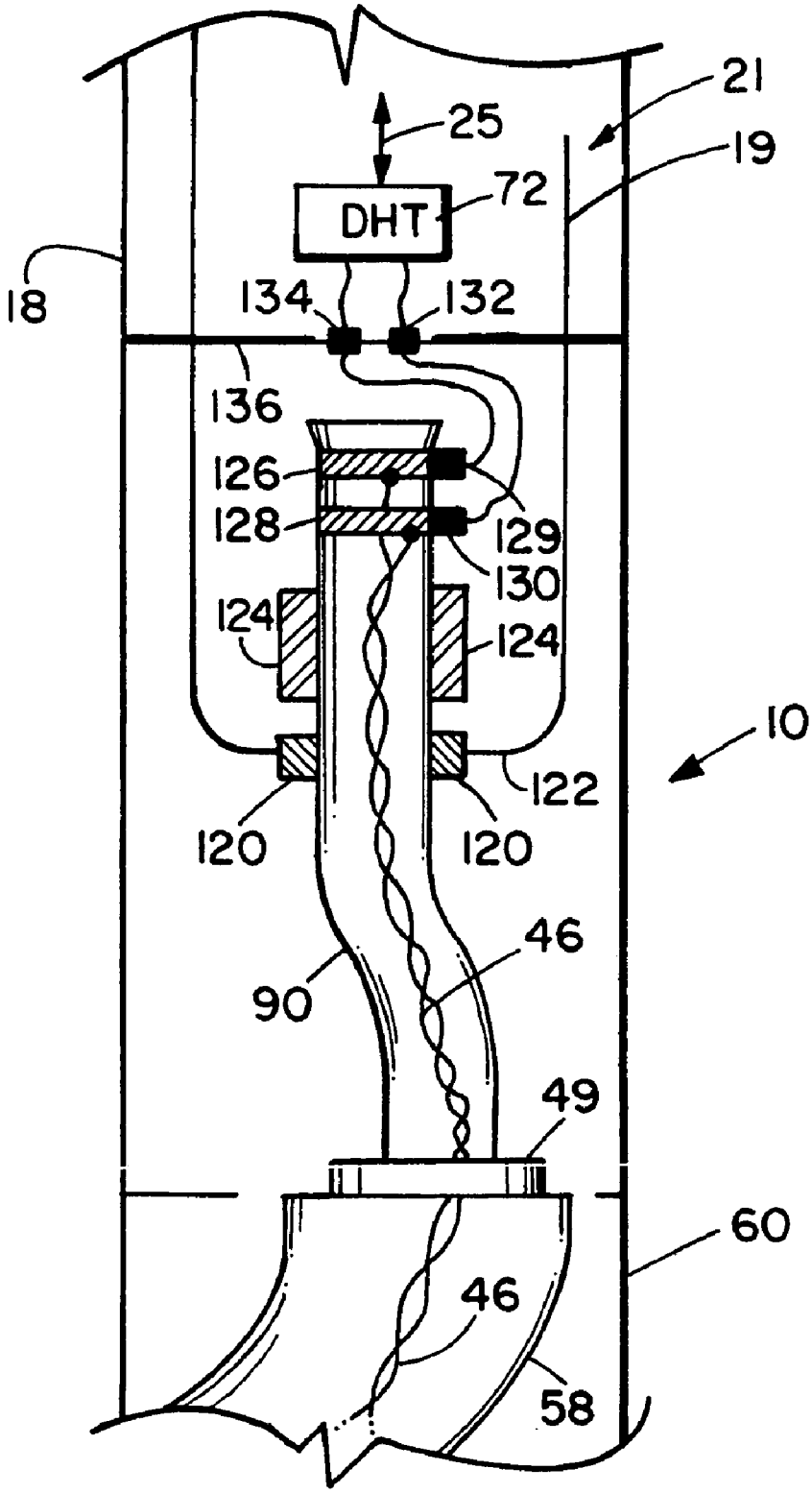
FIG. 6 illustrates a data link using direct electrical contacts rather than current coupling.

FIG. 6 illustrates a data link using direct electrical contacts rather than current coupling. The lower end of the flex shaft 90 is attached to the rotor 58 by means of a flange 49, and the upper end of the flex shaft 90 extends through a seal 120 and into a pressure housing 122. Conductors 46 leading from the instrument sub 12 are once again shown as a twisted pair disposed within the rotor 58 and the flex shaft 90. The conductors are terminated at a lower and upper conductor rings 128 and 126, respectively. The upper and lower conductor rings are electrically insulated from one another and from the flex shaft 90, and rotate with the flex shaft. The flex shaft 90 is supported by a radial bearing 124 disposed below the lower conducting ring 128. It has been previously noted that the number of conductors can vary. A conductor ring is provided for each conductor.

Still referring to FIG. 6, the upper and lower conductor rings 126 and 128 are electrically contacted by upper and lower brushes 129 and 130 that are fixed with respect to the electronics sonde 19. Leads from the from the upper and lower brushes 129 and 130 pass through feed throughs 134 and 132, respectively, and electrically connect with the downhole telemetry unit 72 disposed within the electronics sonde 19. Data are transmitted to and from the downhole telemetry unit 72 as illustrated conceptually by the arrow 25. As stated above, the number of conductors can vary. A conductor ring and a cooperating brush are provided for each conductor.

Figure 7:
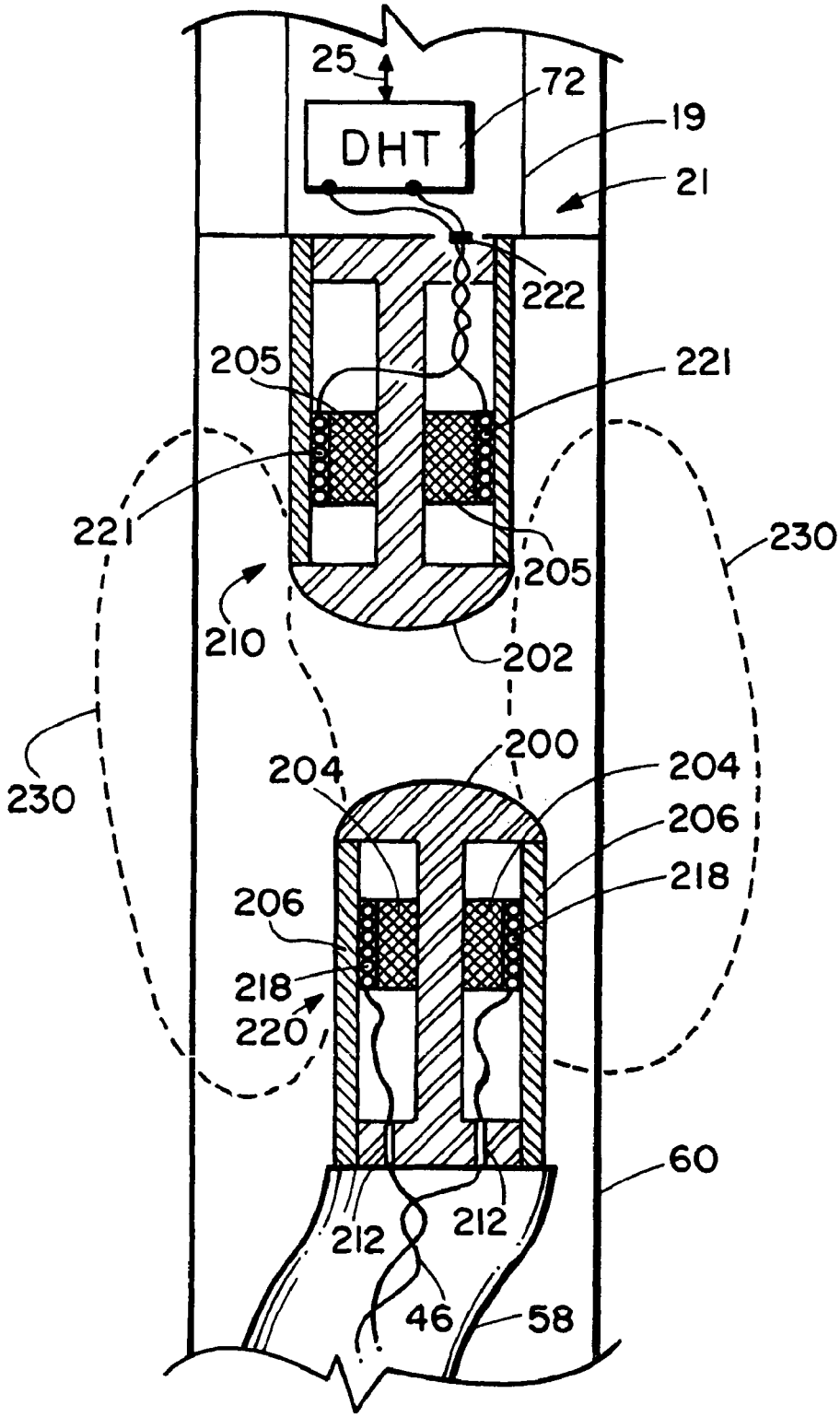
FIG. 7 illustrates a data link using magnetic coupling.

FIG. 7 illustrates still another embodiment of a data link that is based upon magnetic coupling of sensors below the mud motor and the downhole telemetry unit 72 above the mud motor. A lower and an upper magnetic dipole, represented as a whole by 220 and 210, respectively, are used to establish the link. The flex shaft used in previous embodiments has been eliminated. Elements and functions of this embodiment will again be discussed beginning at the bottom of the illustration. The lower dipole 220 is attached to the rotor 58, and comprises a ferrite element 204 surrounding a steel mandrel 200 disposed within outer element 206. Wires 218 are wound around the circumference of the ferrite element 205 and connect through feed through 212 to conductors 46 emerging from the rotor 58.

Still referring to FIG. 7, the upper dipole 210 is attached to the electronic sonde 19, and comprises a ferrite element 205 surrounding a steel mandrel 202. Wires 221 are wound around the circumference of the ferrite element 205 and connect through feed throughs 222 to the downhole telemetry unit 72 disposed in the electronics sonde 19. Data are transmitted to and from the downhole telemetry unit 72 as illustrated conceptually by the arrow 25.

Again referring to FIG. 7, the upper and lower dipoles 210 and 220 rotate with respect to one another thereby forming a magnetic coupling illustrated conceptually by the broken curves 230. The magnetic filed generated by the lower dipole 220 is indicative of the response of elements of the instrument sub 12, such responses of a sensor 40 (see FIG. 2). This magnetic field induces a corresponding data current signal is in the upper dipole 210, which is typically telemetered to the surface via the downhole telemetry unit 72. Conversely, data can be transmitted to the instrument sub 12 from the surface via the same magnetic link. The link illustrated in FIG. 7 is not suitable for the transfer of power.

Two MWD/LWD geophysical steering applications of the system are illustrated to emphasize the importance of disposing the instrument sub 12 as near as possible to the drill bit 14. It is again emphasized that the system is not limited to geosteering applications, but can be used in virtually any LWD/MWD application with one or more sensors disposed in the instrument sub 12. In applications where the axial displacement between sensors and the drill bit is not critical, additional sensors can be disposed within the electronics sonde 19 or in the wall of the electronics sub 18. These applications include, but are not limited to, LWD type measurements made when the drill string is tripped.

For purposes of geosteering illustration, it will be assumed that the one or more sensors 40 in the instrument sub 12 comprise a gamma ray detector and an inclinometer. Using the response of these two sensors, the position of the bottom hole assembly 10 in one earth formation can be determined with respect to adjacent formations. Gamma radiation and inclinometer data are telemetered to the surface in real time using previously discussed methodology thereby allowing the path of the advancing borehole to be adjusted based upon this information. Some processing of the sensor responses can be made in one or more processors disposed within elements of the bottom hole assembly 10 where the information is decoded by appropriate data acquisition software.

Figure 8:
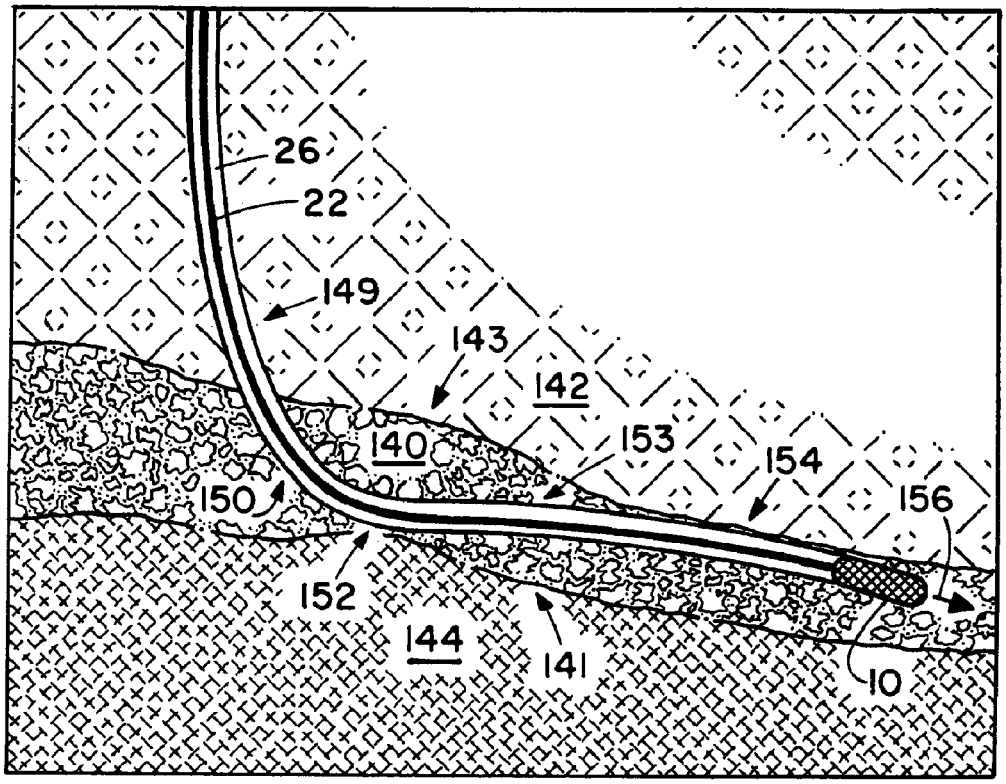
FIG. 8 shows a borehole drilled by the bottom hole assembly and penetrating an oil bearing formation and bounded by non oil bearing formation.

FIG. 8 shows a borehole 26 penetrating several earth formations. As shown, the bottom hole assembly 10, operationally attached to the drill string 22, is advancing the borehole 26 in an oil bearing formation 140. The objective of the drilling operation is to advance the borehole 26 within the oil bearing formation 140, as shown, thereby maximizing hydrocarbon production from this formation. As illustrated in FIG. 8, the oil bearing formation 142 is relatively thin, and bounded by "floor" and "ceiling" formations 144 and 142 at bed boundaries 152 and 143, respectively. Natural gamma radiation levels in oil bearing formations are typically low. Oil bearing formations are typically bounded by shales, which exhibit high natural gamma ray activity. For purposes of illustration, it will be assumed that the oil bearing formation 140 is low in gamma ray activity, and the bounding "floor" and "ceiling" formations 144 and 142, respectively, that are shales exhibiting relatively high levels of natural gamma radiation.

Figure 9:
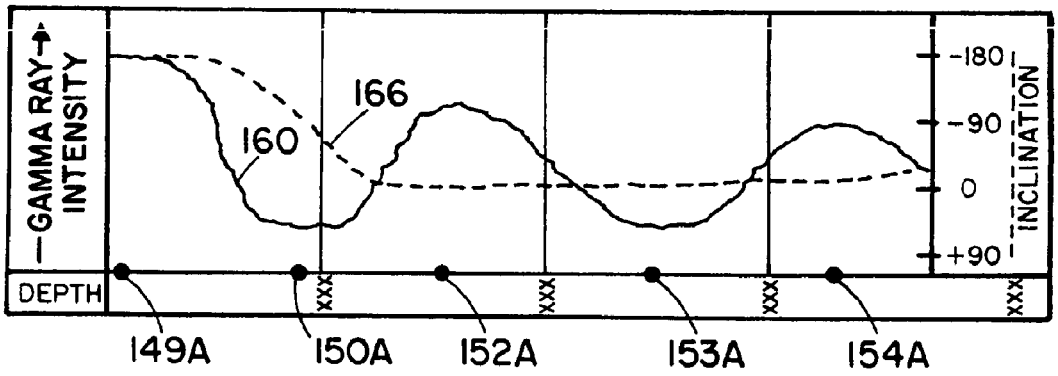
FIG. 9 shows a log obtained from gamma ray and inclinometer sensors within said bottom hole assembly.

FIG. 9 is a "log" of a measure of natural gamma ray intensity (ordinate), depicted as the solid curve 160, as a function of depth (abscissa) along the borehole 26. The broken curve 166 of FIG. 9 illustrates a log of the inclination bottom hole assembly 10, as measured by the inclinometer sensor, as a function of depth. Downward vertical is arbitrarily denoted as −180 degrees, and horizontal is denoted as 0 degrees. As will be discussed below, this log information is telemetered in real time to the surface thereby allowing drilling direction changes to be made quickly in order to remain within the target formation.

Referring to both FIGS. 8 and 9, the borehole is within the ceiling shale formation 142 at a depth 149, and the borehole 26 is near vertical. This is represented on the log of FIG. 9 at depth 149A as a maximum gamma radiation reading and an inclinometer reading of about −180 degrees. As the borehole enters the oil bearing formation 140 as indicated by a decrease in gamma radiation, the borehole is diverged from the vertical by the driller in order to remain within this target formation. At 150 of FIG. 8, it can be seen that the borehole is near the center of the formation 140, and the inclination is about −90 degrees. This location is reflected in at depth 150A in the log of FIG. 9 by minimum gamma radiation intensity and an inclination of approximately −90 degrees. Between 150 and 152 of FIG. 8, it can be seen that the borehole is approaching the bed boundary 152 of the floor formation 144 by the driller. The gamma ray detector senses the close proximity of the formation, and is reflected as an increase in gamma radiation at a depth 152A of the FIG. 9 log. This alerts the driller—that the borehole is approaching floor formation, and the drilling direction must be altered to near horizontal so that the bottom hole assembly 10 remains within the target zone 140. The broken curve 166 indicates at 152A that the borehole is near horizontal. As seen in FIG. 8, the borehole 26 is essentially horizontal between 152 and 154, but is approaching the bed boundary 143 of the ceiling formation 142. This is sensed by the gamma ray detector and is reflected in an increase in gamma radiation that reaches a maximum at depth 154A. This increase is observed in real time by the driller. As a result of this real time observation, the drilling direction is adjusted downward between 153 and 154 until a decrease in gamma radiation below depth 154A indicates that the bottom hole assembly 10 is once again being directed toward the center of the target formation. This change in inclination is reflected In FIG. 9 by the broken curve 166 at a depth between 153A and 154A.

To summarize, the system can be embodied to steer the drilling operation and thereby maintain the advancing borehole within a target formation. In this application, where directional changes are made based upon sensor responses, it is of great importance to dispose the sensors as close as possible to the drill bit. As an example, if the sensor sub were disposed above the mud motor, the floor formation 144 could be penetrated at 152 before the driller would receive an indication of such on the gamma ray log 160. The present system permits sensors to be disposed as close a two feet from the drill bit.

Figure 10:
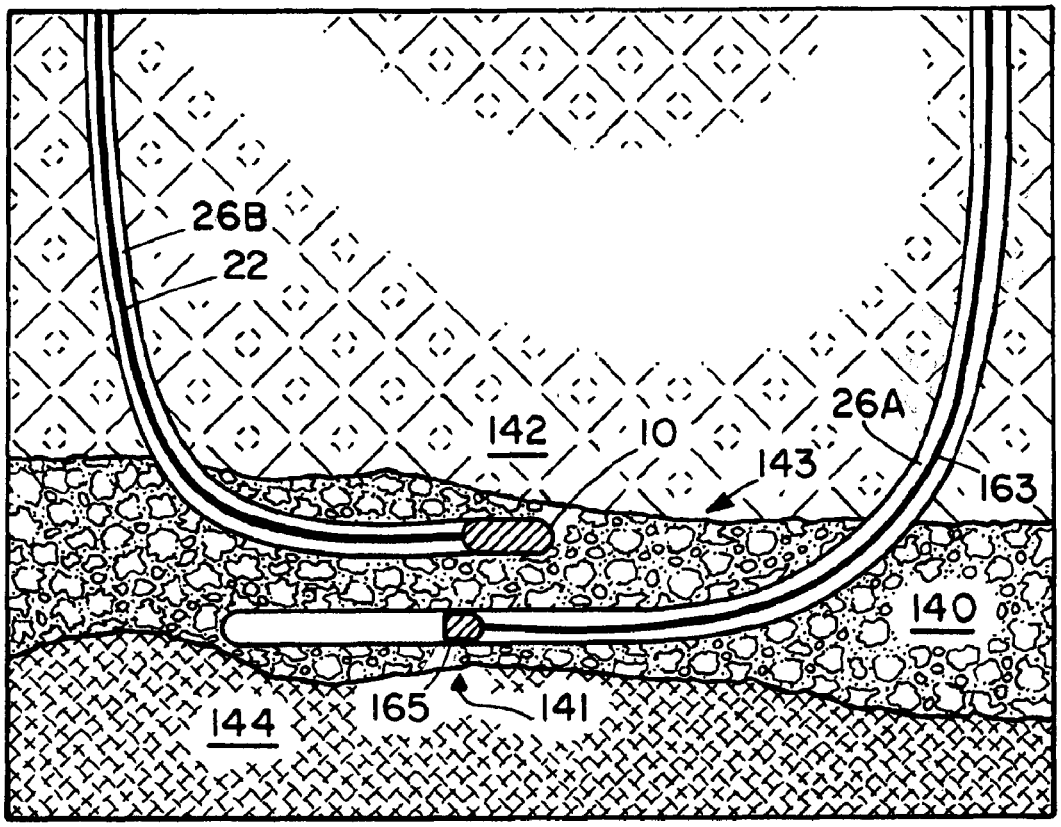
FIG. 10 illustrates a pair of steam assisted gravity drainage (SAG-D) wells drilled using the geosteering and other features of the invention.

The drill bit-sensor arrangement of the invention is also very useful in the drilling of steam assisted gravity drainage (SAG-D) wells. SAG-D wells are usually drilled in pairs, as illustrated in FIG. 10. The drilling system and cooperating bottom hole assembly 10 are typically used to drill the curve and lateral sections of the first well borehole 26A. Using the geosteering methodology discussed above, this borehole is drilled within the oil bearing formation 140 but near the bed boundary 141 of the floor formation 144. Once the borehole 26A is completed, a magnetic ranging tool 165 is disposed within the borehole 26A. The second well borehole 26B drilled with a magnet sensor as one of the sensors 40 used in the sensor sub 12 (see FIG. 2) of the bottom hole assembly 10. The magnetic sensor responds to the location of the magnetic ranging tool 165 in borehole 26A and is, therefore, used to determine the proximity of the borehole 26B relative to the borehole 26A. The borehole pairs are typically drilled within close proximity to one another, with tight tolerances in the drilling plan, in order to optimize the oil recovery from the target formation 140. Steam is pumped into the upper borehole 26B, which heats oil in the target formation 140 causing the viscosity to decrease. The low viscous oil then migrates downward toward the lower borehole 26A where it is collected and pumped to the surface.

To summarize, the effective drilling SAG-D wells require sensors to be disposed as close as possible to the drill bit in order to meet the tight tolerances of the drilling plan.

One skilled in the art will appreciate that the present invention can be practiced by other that the described embodiments, which are presented for purposes of illustration and not limitation, and the present invention is limited only by the claims that follow.

What is claimed is:

1. A borehole assembly system comprising:
an instrument sub comprising at least one sensor;
an electronics sub comprising an electronics sonde having a downhole telemetry unit disposed therein;
a mud motor disposed between said instrument sub and said electronics sub; and
a conductor disposed in said mud motor with a lower terminus electrically connected to said instrument sub and an upper terminus electrically connected to a link disposed between said mud motor and said electronics sonde, wherein
said instrument sub is rotatable with respect to said electronics sub; and
said link provides operational coupling between said instrument sub and said electronics sonde; and
wherein said link comprises:
an upper magnetic dipole; and
a lower magnetic dipole rotatable with respect to said upper magnetic dipole; wherein
the upper magnetic dipole and the lower magnetic dipole each comprise a ferrite element surrounding a steel mandrel with wires wound around the circumference of the ferrite element and said upper and lower magnetic dipoles provide said operational coupling by magnetic coupling.

2. The borehole assembly system of claim 1 wherein the instrument sub includes a lower end that receives a drill bit.

3. The borehole assembly system of claim 1 wherein a lower end of said mud motor is operationally attached to an upper end of said instrument sub.

4. The borehole assembly system of claim 1 wherein a lower end of said electronics sub is operationally attached to an upper end of said mud motor.

5. The borehole assembly system of claim 1 wherein said operational coupling comprises data transmitted between said at least one sensor and said downhole telemetry unit.

6. The borehole assembly system of claim 1 further comprising:
a power supply disposed within said electronics sub; wherein
said power supply is electrically connected to said upper magnetic dipole; and
said operational coupling comprises power from said power supply transmitted to said instrument sub via said magnetic coupling and said at least one conductor.

7. A system comprising a bottom hole assembly and an uphole telemetry unit disposed within surface equipment; wherein:
said bottom hole assembly comprises:
an instrument sub comprising at least one sensor;
an electronics sub comprising an electronics sonde having a downhole telemetry unit disposed therein;
a mud motor disposed between said instrument sub and said electronics sub; and
a conductor disposed in said mud motor with a lower terminus electrically connected to said instrument sub and an upper terminus electrically connected to a link disposed between said mud motor and said electronics sonde, wherein
said instrument sub is rotatable with respect to said electronics sub; and
said link provides operational coupling between said instrument sub and said electronics sonde; and
wherein said link comprises:
an upper magnetic dipole; and
a lower magnetic dipole rotatable with respect to said upper magnetic dipole; wherein
the upper magnetic dipole and the lower magnetic dipole each comprise a ferrite element surrounding a steel mandrel with wires wound around the circumference of the ferrite element and said upper and lower magnetic dipoles provide said operational coupling by magnetic coupling;
and wherein:
said bottom hole assembly is configured to be conveyed within a borehole using a drill string;

said system is configured so that response data from said at least one sensor is telemetered to said uphole telemetry system via a borehole telemetry system; and said system is configured so that said response data are processed as a function of depth measured within said borehole thereby forming a log of a parameter of interest.

8. The system of claim 7 wherein a command for controlling said bottom hole assembly is telemetered form said surface equipment via said uphole telemetry unit and said borehole telemetry system and received by said downhole telemetry unit.

9. The system of claim 7 wherein said operational coupling comprises data transmitted between said at least one sensor and said downhole telemetry unit.

10. The system of claim 7 wherein said bottom hole assembly further comprises:

a power supply disposed within said electronics sub; wherein said power supply is electrically connected to said upper magnetic dipole; and said operational coupling comprises power from said power supply transmitted to said instrument sub via said magnetic coupling and said at least one conductor.

11. In a bottom hole assembly, a method for operationally coupling an instrument sub and an electronics sub with a mud motor disposed there between, the method comprising:

disposing a conductor in said mud motor with a lower, terminus electrically connected to said instrument sub and an upper terminus electrically connected to a link disposed between said mud motor and said electronics sonde, wherein said instrument sub is rotatable with respect to said electronics sub; and said link provides said operational coupling between said instrument sub and said electronic sonde wherein said link is provided by;

operationally connecting an upper magnetic dipole to said electronics sonde; and operationally connecting a lower magnetic dipole to a rotor element of said mud motor, wherein;

said lower magnetic dipole is rotatable with respect to said upper magnetic dipole; and the upper magnetic dipole and the lower magnetic dipole each comprise a ferrite element surrounding a steel mandrel with wires wound around the circumference of the ferrite element and said upper and lower magnetic dipoles provide said operational coupling by magnetic coupling.

12. The method of claim 11 wherein said operational coupling comprises data transmitted between said at least one sensor and said downhole telemetry unit.

13. The method of claim 11 further comprising the steps of:

disposing a power supply within said electronics sub; and electrically connecting said power supply to said upper toroid; wherein said operational coupling comprises power from said power supply transmitted to said instrument sub via said current coupled upper and lower toroids and said at least one conductor.

14. A method of logging a borehole, the method comprising:

conveying a bottom hole assembly through the borehole using a drill string, wherein said bottom hole assembly comprises:

an instrument sub comprising at least one sensor;

an electronics sub comprising an electronics sonde having a downhole telemetry unit disposed therein;

a mud motor disposed between said instrument sub and said electronics sub; and a conductor disposed in said mud motor with a lower terminus electrically connected to said instrument sub and an upper terminus electrically connected to a link disposed between said mud motor and said electronics sonde, wherein said instrument sub is rotatable with respect to said electronics sub and said link provides operational coupling between said instrument sub and said electronics sonde, said link comprising an upper magnetic dipole and a lower magnetic dipole rotatable with respect to said upper magnetic dipole, wherein the upper magnetic dipole and the lower magnetic dipole each comprise a ferrite element surrounding a steel mandrel with wires wound around the circumference of the ferrite element and said upper and lower magnetic dipoles provide said operational coupling by magnetic coupling;

telemetering response data from said at least one sensor to an uphole telemetry system via a borehole telemetry system; and processing said response data as a function of depth measured within said borehole, thereby forming a log of a parameter of interest.

15. The method of claim 14 further comprising telemetering a command for controlling said bottom hole assembly from said surface equipment via said uphole telemetry unit to said downhole telemetry unit.

16. The system of claim 14 wherein said operational coupling comprises data transmitted between said at least one sensor and said downhole telemetry unit.

17. The system of claim 14 wherein said bottom hole assembly further comprises:

a power supply disposed within said electronics sub; wherein said power supply is electrically connected to said upper magnetic dipole; and said operational coupling comprises power from said power supply transmitted to said instrument sub via said magnetic coupling and said at least one conductor.

* * * * *